US009617861B2

(12) United States Patent
Klaen et al.

(10) Patent No.: US 9,617,861 B2
(45) Date of Patent: Apr. 11, 2017

(54) GUIDE VANE ARRANGEMENT AND METHOD FOR MOUNTING A GUIDE VANE

(71) Applicant: MTU Aero Engines AG, Munich (DE)

(72) Inventors: Stephan Klaen, Berlin (DE); Norbert Schinko, Munich (DE)

(73) Assignee: MTU AERO ENGINES AG, Munich (DE)

( * ) Notice: Subject to any disclaimer, the term of this patent is extended or adjusted under 35 U.S.C. 154(b) by 357 days.

(21) Appl. No.: 14/305,134

(22) Filed: Jun. 16, 2014

(65) Prior Publication Data

US 2015/0016984 A1 Jan. 15, 2015

(30) Foreign Application Priority Data

Jun. 20, 2013 (DE) ..... 10 2013 211 629

(51) Int. Cl.
*F01D 9/02* (2006.01)
*F01D 17/16* (2006.01)
*F01D 11/00* (2006.01)

(52) U.S. Cl.
CPC ..... *F01D 9/02* (2013.01); *F01D 17/162* (2013.01); *F01D 11/001* (2013.01); *F05D 2230/60* (2013.01); *Y10T 29/49321* (2015.01)

(58) Field of Classification Search
CPC ..... F01D 9/02; F01D 17/16; F01D 17/162; F01D 17/165; F01D 11/001; F04D 29/56; F05D 2230/60; Y10T 29/49323
See application file for complete search history.

(56) References Cited

U.S. PATENT DOCUMENTS 3,079,128 A * 2/1963 Burge ..... F01D 11/001 415/174.4
4,604,030 A * 8/1986 Naudet ..... F01D 11/001 415/126
4,792,277 A * 12/1988 Dittberner, Jr. ..... F01D 11/001 415/160

(Continued)

FOREIGN PATENT DOCUMENTS

DE 69900004 T2 3/2001
DE 102009038623 A1 3/2011
EP 0204615 B1 3/1989

(Continued)

*Primary Examiner* — Dwayne J White
*Assistant Examiner* — Sang K Kim
(74) *Attorney, Agent, or Firm* — Barlow, Josephs & Holmes, Ltd.

(57) ABSTRACT

The invention relates to a guide vane arrangement and a method for mounting a guide vane. The guide vane arrangement has at least one guide vane having a radially inner journal, which engages in a borehole of a bushing. The bushing is disposed in a borehole of an inner ring segment. The journal is connected to the bushing in a rotation-resistant manner and a slide mounting is provided between the bushing and the inner ring borehole. For mounting the guide vane in an inner ring segment, the journal of the guide vane is introduced into the borehole of the bushing. Further, the journal is fastened to the bushing in a rotation-resistant manner, and the bushing is slide-mounted with the inner ring segment. The slide mounting is conducted prior to or simultaneously with or after the fastening of the journal to the bushing in a rotation-resistant manner.

8 Claims, 5 Drawing Sheets

(56) References Cited

U.S. PATENT DOCUMENTS

| | | | | |
|---|---|---|---|---|
| 6,129,512 | A * | 10/2000 | Agram | F01D 17/162<br>415/160 |
| 2003/0170115 | A1 * | 9/2003 | Bowen | F01D 9/02<br>415/160 |

FOREIGN PATENT DOCUMENTS

| | | | | |
|---|---|---|---|---|
| FR | GB 2273744 | A * | 6/1994 | F01D 17/162 |
| FR | EP 0780545 | A1 * | 6/1997 | F01D 17/162 |
| FR | CA 2455016 | A1 * | 7/2004 | F01D 17/16 |

* cited by examiner

GUIDE VANE ARRANGEMENT AND METHOD FOR MOUNTING A GUIDE VANE

BACKGROUND OF THE INVENTION

The invention relates to a guide vane for guide vane arrangement, and a method for fastening or mounting such a guide vane.

A multiple number of differently designed turbomachines are already known from the prior art. Turbomachines have a housing through which a flow can pass axially, on which at least one guide vane ring is fastened, which has a plurality of guide vanes disposed next to one another in the peripheral direction. On their radially inner end, the guide vanes have an end segment, which can be joined with a seal support in a detachable manner. The seal support serves for sealing a gap between the guide vane, in particular, the end segment, and a rotor of the turbomachine.

Guide vanes that can be adjusted about their longitudinal axis, are connected in a movable manner on their radial end to an inner ring segment as an end section. According to internal company practice, a radially inner end of the guide vane, such as, for example, a journal provided on the vane section, is taken up in a bushing, which is fixed in place by the inner ring segment. The inner ring segment is in turn connected in a detachable manner to a seal support segment. The guide vane must be fixed in the radial direction in the inner ring segment in such a way that it is assured that the guide vane can be adjusted about its own longitudinal axis.

A guide vane that has a crosswise bearing member in the form of a spherical disk on its radially inner end is known from DE 10 2009 038 623 A1. For bearing the guide vane on the inner ring segment, a spherical disk is introduced into a bearing mount provided in the inner ring segment.

It is a particular disadvantage in the above-named connection that the components that are required for the movable bearing of the guide vane on the inner ring segment require a large structural space.

BRIEF SUMMARY OF THE INVENTION

An object of the present invention is to provide an improved turbomachine having at least one guide vane arrangement. Another object of the present invention is to provide, in particular, a guide vane that requires less structural space for the fixing in place or bearing on the inner ring segment. Additionally or alternatively, another object of the present invention is to provide a method by means of which the guide vane can be connected in a simple way to the inner ring segment.

According to the invention, a guide vane arrangement is provided with one or more guide vanes. At least one guide vane has a radially inner journal, which engages in a borehole of a bushing, which is disposed in a borehole of an inner ring segment. The journal can extend radially inward from a radially inner end of a vane section of the guide vane. A rotation-resistant connection is provided between the journal and the bushing; a slide bearing or mounting is provided between the bushing and the borehole of the inner ring segment in the direction of rotation about the borehole or adjustment axis. In one embodiment, the inner ring segment has several boreholes in the peripheral direction, whereby bushings are slide-mounted at least in two boreholes, in particular, in the two outer or end-side boreholes in the peripheral direction; journals of guide vanes are engaged in the boreholes of the bushings and these journals are connected to these bushings in a rotation-resistant manner.

The journals of one or more, in particular, all of the other guide vanes of the inner ring segment can be joined to bushings in the same way in a rotation-resistant manner, these bushings being slide-mounted in boreholes of the inner ring segment. In another embodiment, the journals of one or more, in particular, all of the other inner guide vanes of the inner ring segment, in particular, in the peripheral direction, can be mounted rotatably in their bushings or slide-mounted, the bushings in turn being able to be slide-mounted in boreholes of the inner ring segment.

As a rotation-resistant or rotationally-fixed connection between a journal and a bushing is understood, in particular, a connection in which the journal and the bushing cannot rotate relative to one another, at least substantially or macroscopically. The slide mounting between a bushing and a borehole of the inner ring segment can be designed in one embodiment by a loose fit.

Such a guide vane arrangement can have the advantage that by the use of the rotation-resistant connection between one or more journals and the respective bushing and by the slide mounting between this bushing or these bushings and the respective borehole(s) of the inner ring segment, the assembly of the guide vane arrangement, in particular the incorporation of the guide vane in the inner ring segment, is simplified. Additionally, a fixing in place of the guide vane in the radial direction can be achieved in one embodiment. Additionally or alternatively, the guide vane arrangement, in particular, the guide vane can be dismounted from the inner ring segment in a simpler way. The space requirement for the components necessary for fixing in place is small in one embodiment, so that advantageously, a plurality of guide vanes can also be coupled to the same inner ring segment.

Another advantage of the above-named guide vane arrangement can consist in the fact that, based on the rotation-resistant connection between at least one guide vane and its bushing, when there is an adjustment of the guide vane about its longitudinal axis, both the guide vane as well as the bushing rotate. A rotation of the bushing offers the advantage that wear occurs mainly on the bushing and not on the journal of the guide vane as in the embodiments known from the prior art. Therefore, during maintenance of the turbomachine, only the bushing needs to be changed and no longer does the complete guide vane need changing. Further, based on the rotation-resistant connection between the journal of the guide vane and the bushing, the support width of the bearing advantageously increases.

In a preferred embodiment, the journal may have an outer thread and the bushing may have an inner thread screwed or screwable therewith. Alternatively or additionally, a threaded sleeve, which can be connected to the journal and/or the bushing in a rotation-resistant manner, can be disposed between the journal and the bushing. The journal can be connected to the threaded sleeve by a screw connection. Alternatively or additionally, the bushing can be connected to the threaded sleeve by a screw connection. Alternatively or additionally, the journal may have an outer thread, which is screwed with or can be screwed with an inner thread of a nut. The nut can be supported against the bushing, in particular in a state in which it is screwed with the journal. Further, the nut can be disposed on the side of the bushing facing away from the vane section of the guide vane.

An advantage of the above-named connection possibilities may consist in the fact that the guide vane can be connected in a rotation-resistant manner in a simple way to the inner ring segment, in particular, to the bushing.

A screw locking device may be provided for securing the screw connection. The screw locking device prevents a loosening of the screw connection between the guide vane and the inner ring segment. Therefore, a secure connection is assured between the guide vane and the inner ring segment due to the screw locking device. In one embodiment, the screw locking device may have a split pin locking device and/or a locking pin and/or a snap ring locking device, and/or a locking wire.

The inner ring segment can be connected in a detachable manner with a seal support segment, in particular, by a form-fitting connection. Further, the inner ring segment can be coupled with at least one guide vane. The seal support segment may have a sealing means, which extends from the seal support segment in a direction facing away from the inner ring segment. The seal support segment, in particular, the sealing means, serves for sealing a gap between the guide vane, in particular, the inner support segment, and a rotor of the turbomachine.

According to another aspect of the invention, a guide vane is provided that has a journal with an outer thread. The journal can project from the radially inner end of the vane section. In particular, the journal can be inserted into the borehole of the bushing, which is disposed in the borehole of the inner ring segment.

The above-described guide vane arrangement or guide vane can be used in a gas turbine, in particular, an aircraft engine having at least one compressor stage and/or turbine stage. The use of the guide vane arrangement or guide vane, however, is not limited to the gas turbine and the aircraft engine, but can also be utilized in other turbomachines.

According to another aspect of the invention, the mounting of at least one guide vane in an inner ring segment proceeds as follows: The journal of the guide vane is inserted into the borehole of the bushing, which in one embodiment is already disposed in the borehole of the inner ring segment. In another embodiment, the journal of the guide vane is first introduced into the borehole of the bushing, which is subsequently disposed in the borehole of the inner ring segment. Similarly, the introduction of the journal into the bushing and the bushing into the inner ring segment can also be jointly conducted, at least substantially.

The journal is rotationally fixed or attached in a rotation-resistant manner with the bushing. The fastening that is rotation-resistant can be produced, in particular, by a screw connection or a screwing together. The bushing is slide-mounted with the inner ring segment. The slide mounting of the bushing with the inner ring segment, as mentioned above, can be produced prior to, or simultaneously with, or after the rotation-resistant fastening of the journal with the bushing. As a consequence of the slide mounting, a relative movement, in particular, a relative rotation, is possible between the bushing and the inner ring segment. In one embodiment, a dismounting can be produced in reverse sequence.

A mounting and/or dismounting of the guide vane is possible in a simple and rapid manner by means of the above-described method.

BRIEF DESCRIPTION OF THE DRAWINGS

Further advantages and features result from the present invention and the example of embodiment. Here.

DETAILED DESCRIPTION OF THE INVENTION

A turbomachine, which is not shown in its entirety, has several rotor disks and guide vane rings which are disposed displaced relative to one another in the axial direction of the turbomachine. The guide vane rings are disposed along the axial direction of the turbomachine, each one disposed between two rotor disks, and each one has a plurality of guide vanes 110 in the peripheral direction.

Figure 1:
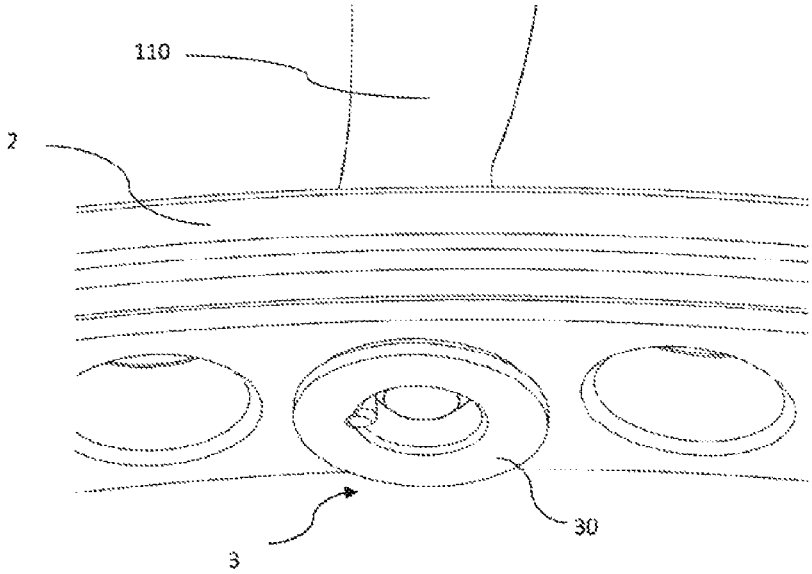
FIG. 1 shows a perspective view of an excerpt of the connection of a guide vane to an inner ring segment of a turbomachine according to one embodiment of the present invention.
Figure 2:
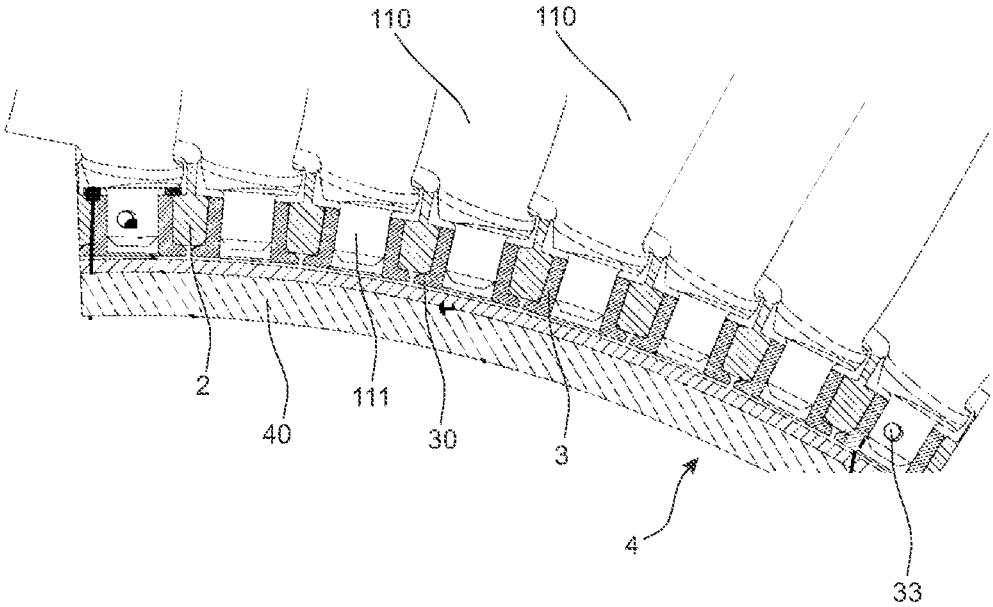
FIG. 2 shows a lateral sectional view of a plurality of guide vanes of the turbomachine of FIG. 1 that are adjacent in the peripheral direction.

The guide vanes 110 shown in FIGS. 1, 2 involve vanes that can be adjusted about their longitudinal axis. The guide vanes 110 are connected at their radially inner end with an inner ring segment 2. At the radially inner end of the inner ring segment 2, a flange 30 of a bushing 3 projects in the radial direction from the inner ring segment 2. The inner ring segment 2 that is shown is a component of an inner ring, which is composed of a plurality of inner ring segments 2 that are adjacent in the peripheral direction.

FIG. 2 shows a lateral sectional view of a plurality of guide vanes 110 that are adjacent in the peripheral direction. In this case, each guide vane 110 has a vane section, which possesses a journal 111 on the radially inner end. The journal 111 projects from the vane section in the radial direction and engages in a borehole of a bushing 3. The bushings 3 are disposed in boreholes of the inner ring segment 2.

Each of the journals 111 of the outer guide vanes in the peripheral direction (left, right in FIG. 2) has an outer thread, which is engaged with an inner thread of the respective bushing 3. The bushings 3 are slide-mounted in boreholes of the inner ring segment 2. This means that the bushings 3 can be rotated relative to the inner ring segment 2. It is simultaneously assured that no relative movement is possible between the outer bushings 3 in the peripheral direction and the outer guide vanes 110 in the peripheral direction, in particular, their journals 111.

The journals 111 of the remaining or inner guide vanes in the peripheral direction (the second to seventh guide vanes in FIG. 2) do not have an outer thread, but are slide-mounted in the boreholes of the respective bushing 3. These bushings 3 are slide-mounted or rotationally fixed in boreholes of the inner ring segment 2. Similarly, these journals 111 may also be rotationally fixed in the boreholes of the respective bushing 3, which in turn are slide-mounted in boreholes of the inner ring segment 2.

The inner ring segment 2 is connected to a seal support segment 4. The seal support segment 4 is a component of a seal support, which has a plurality of seal support segments 4 adjacent in the peripheral direction.

Further (alternatively to this or in combination), only the two outer journals 111 of an inner ring segment can be screwed together with the bushings 3. The screw connection can be secured against unscrewing by the split pin 33.

Figure 3:
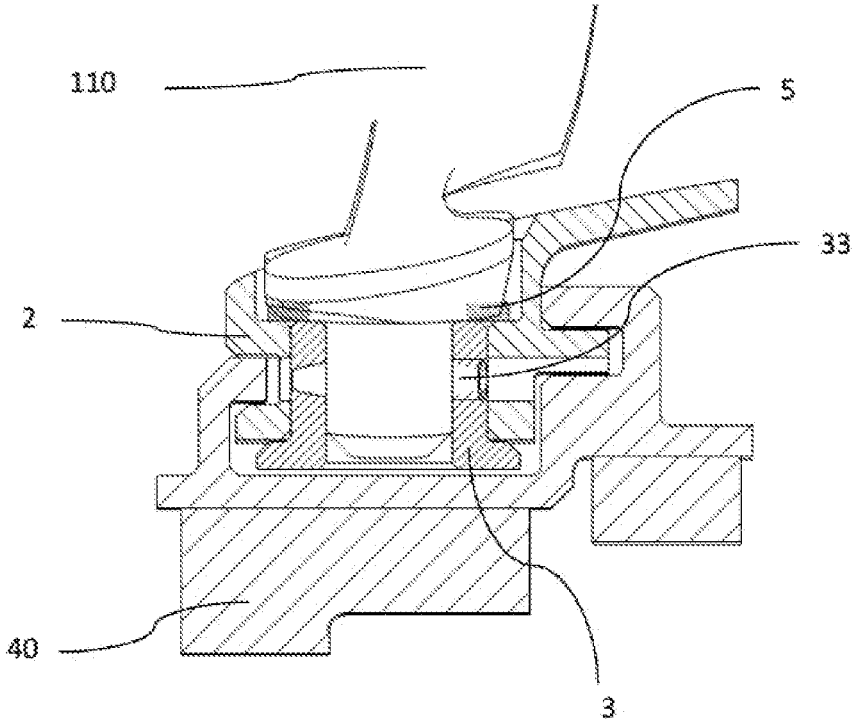
FIG. 3 shows a lateral sectional view of the connection of the guide vane to the inner ring segment of the turbomachine of FIG. 1 with a screw locking device according to one embodiment of the present invention.

An enlarged illustration of a connection of an outer guide vane 110 in the peripheral direction to the inner ring segment 2 is shown in FIG. 3. The seal support segment 4 has a bottom from which extends a sealing means 40 in a direction that is facing away from the inner ring segment 2. Further, two sides, which are connected in a detachable manner with the inner ring segment 2 by means of a form-fitting connection on their ends facing away from the bottom of the seal support segment 4 extend from the seal support segment 4.

The flange 30 of the bushing 3 projects from the inner ring segment 2 and is crosswise to a longitudinal axis of the bushing 3. A slide ring 5, which is disposed between the bushing 3 and the vane section of the guide vane 110, is provided on the end of the bushing facing away from the flange 30.

A screw locking device is provided in order to prevent an unscrewing of the screw connection between the journal 111 and the bushing 3. Therefore, the screw locking device serves for preventing a relative movement between the journal 111 and the bushing 3. The screw locking device according to a first embodiment, which is shown in FIG. 3, corresponds to a split pin locking device. For producing the split pin locking device, a recess is provided in the bushing 3, the journal 111, and a portion of the inner ring segment 2, in which or through which a split pin 33 can be introduced in order to produce the named locking device.

Figure 4:
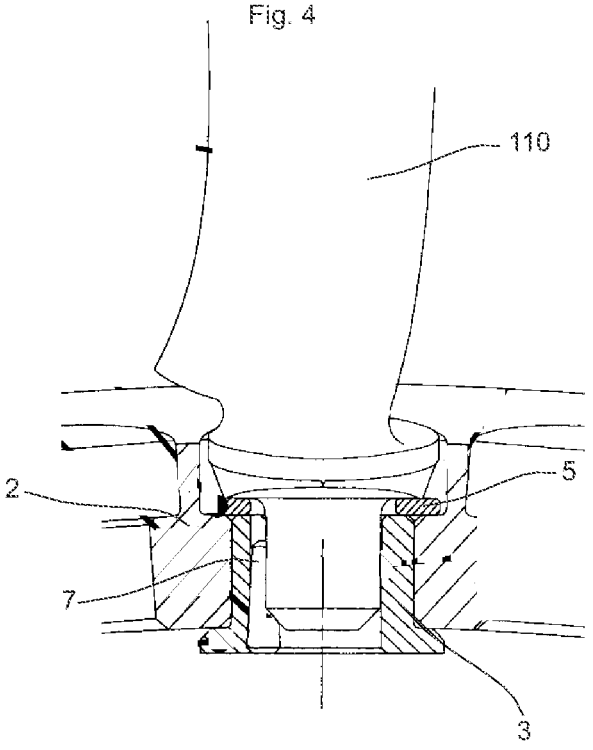
FIG. 4 shows a lateral sectional view of the connection of the guide vane to the inner ring segment of the turbomachine of FIG. 1 with a screw locking device according to another embodiment of the present invention.
Figure 6:
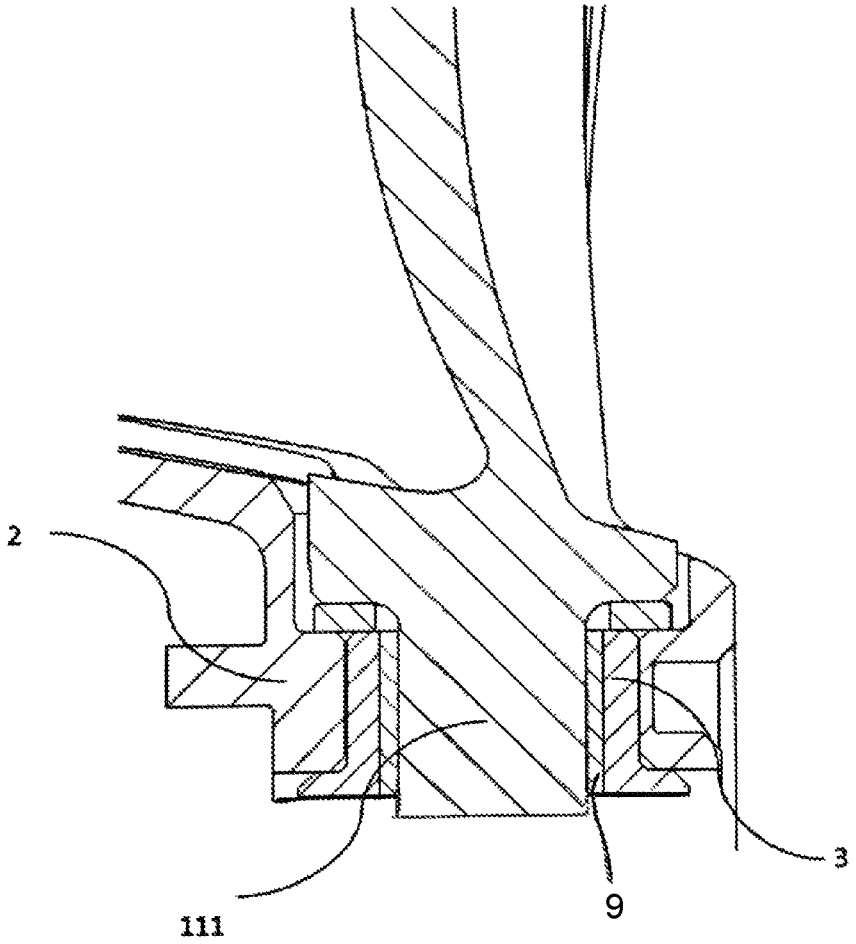
FIG. 6 shows a lateral sectional view of the connection of the guide vane to the inner ring segment of the turbomachine of FIG. 1 with a threaded sleeve between the journal and the bushing according to another embodiment of the present invention.
Figure 7:
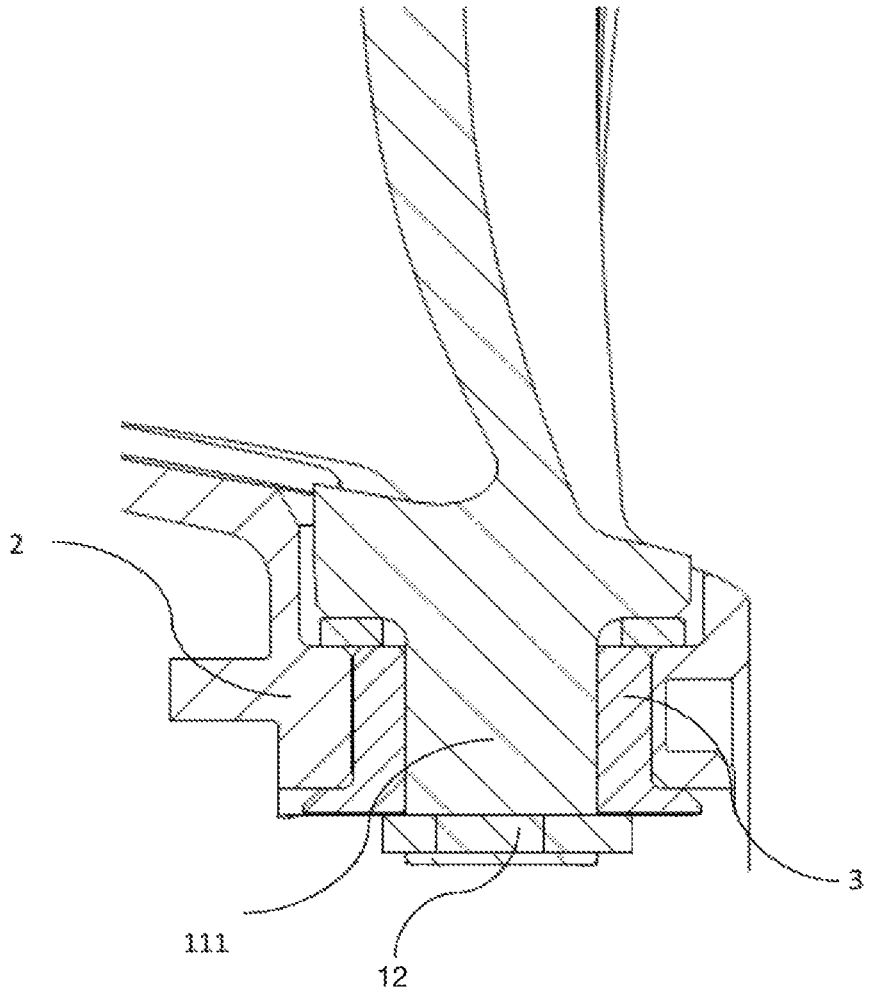
FIG. 7 shows a lateral sectional view of the connection of the guide vane to the inner ring segment of the turbomachine of FIG. 1 with a nut threadably secured to the journal according to another embodiment of the present invention.

A screw locking device according to a second embodiment is shown in FIG. 4. The screw locking device has a locking pin 7, which is inserted into an intermediate space between the journal 111 and the bushing 3. A threaded sleeve 9, as in FIG. 6, and/or a nut 12, as in FIG. 7, may be employed to help secure the bushing 3 relative to journal 111.

Figure 5:
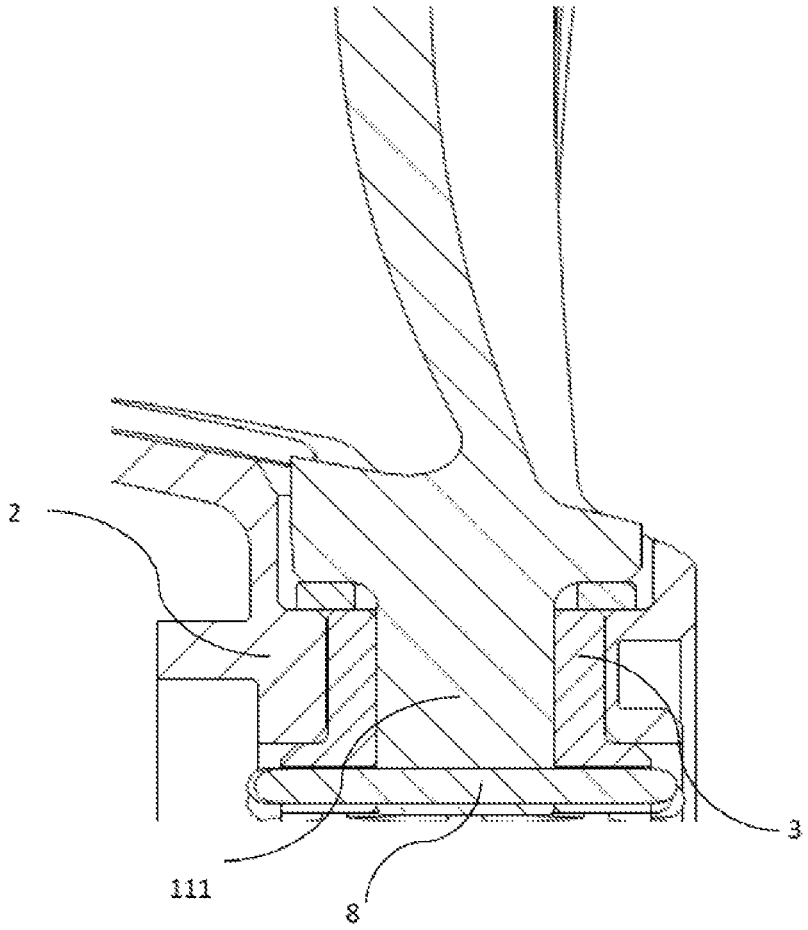
FIG. 5 shows a lateral sectional view of the connection of the guide vane to the inner ring segment of the turbomachine of FIG. 1 with a screw locking device according to yet another embodiment of the present invention.

A screw locking device according to a third embodiment is shown in FIG. 5. In this embodiment, the screw locking device has a locking wire 8. The locking wire 8 is disposed in uptakes in the bushing 3 and is coupled to the journal 111.

The invention claimed is:

1. A guide vane arrangement having at least one guide vane (110) with a radial inner journal (111), which engages in a borehole of a bushing (3), which is disposed in a second borehole of an inner ring segment (2), wherein a rotation-resistant connection is present between the journal (111) and the bushing (3) and a slide mounting is present between the bushing (3) and the borehole of the inner ring segment (2), wherein the journal (111) has an outer thread and the bushing (3) has an inner thread screwed therewith providing a screw connection; and a screw locking device to secure the screw connection of the journal (111) to the bushing (3); a threaded sleeve disposed between the journal (111) and the bushing (3), and the journal (111) and the bushing (3) being connected to the threaded sleeve; the bushing (3), with journal (111) secured thereto, with threaded sleeve disposed therebetween, being freely rotatable within the second borehole of the inner ring segment (2) thereby permitting adjustment of the guide vane (110), attached to the radial inner journal (111), about its longitudinal axis.

2. The guide vane arrangement according to claim 1, wherein the outer thread of the journal (111) is screwed with a nut inner thread of a nut.

3. The guide vane arrangement according to claim 1, wherein the screw locking device has a split pin locking device (33) and/or a locking pin (7) and/or a snap ring locking device and/or a locking wire (8).

4. The guide vane arrangement according to claim 1, wherein the inner ring segment (2) is detachably connected to a seal support segment (4).

5. The guide vane arrangement according to claim 1, wherein at least one additional, outer guide vane (110), in the circumferential direction of the inner ring segment, which is distanced in the peripheral direction, having an additional radially inner journal (111), which engages in a first additional borehole of an additional bushing (3), which is disposed in a second additional borehole of the inner ring segment (2), wherein the additional journal (111) and the additional bushing (3) are connected in a rotation-resistant manner, and the additional bushing (3) is slide-mounted in the second additional borehole of the inner ring segment (2).

6. The guide vane arrangement according to claim 1, wherein at least one additional, inner guide vane (110), in the circumferential direction of the inner ring segment, which is adjacent in the peripheral direction, having an additional radially inner journal (111), which engages in an additional borehole of an additional bushing (3), which is disposed in a second additional borehole of the inner ring segment (2), wherein the additional journal (111) is slide-mounted in the additional bushing (3) and/or the additional bushing (3) is slide-mounted in the second additional borehole of the inner ring segment (2).

7. A guide vane arrangement of claim 1, wherein the guide vane is configured for use in a gas turbine having at least one compressor stage and/or turbine stage.

8. A method for fastening a guide vane (110) to an inner ring segment (2), comprising the steps of:

providing a guide vane with a journal (111);

providing a bushing with a first borehole;

providing an inner ring segment with a second borehole;

providing a threaded sleeve between the journal (111) and the bushing (3) with the journal (111) and the bushing (3) being connected to the threaded sleeve;

introducing the journal (111) of the guide vane (110) into the first borehole of the bushing (3) with the threaded sleeve residing therebetween, prior to, simultaneously with, or subsequently arranging the bushing in the second borehole of the inner ring segment (2);

prior to, simultaneously with, or subsequently attaching the journal (111) to the bushing (3) in a rotation-resistant manner; and slide-mounting the bushing (3), with journal (111) secured thereto, within the second borehole of the inner ring segment (2) to adjust the guide vane (110), attached to the radial inner journal (111), about its longitudinal axis.

* * * * *